US006173618B1

(12) United States Patent
Ruff

(10) Patent No.: US 6,173,618 B1
(45) Date of Patent: Jan. 16, 2001

(54) ORE PASS LEVEL AND BLOCKAGE LOCATOR DEVICE

(75) Inventor: Todd M. Ruff, Deer Park, WA (US)

(73) Assignee: The United States of America as represented by the Department of Health and Human Services, Washington, DC (US)

( * ) Notice: Under 35 U.S.C. 154(b), the term of this patent shall be extended for 0 days.

(21) Appl. No.: 09/361,828

(22) Filed: Jul. 27, 1999

(51) Int. Cl.[7] ..... G01L 1/29
(52) U.S. Cl. ..... 73/862.393; 73/772
(58) Field of Search ..... 73/767, 772, 794, 73/795, 804, 862.391, 862.392, 862.393

(56) References Cited

U.S. PATENT DOCUMENTS

| | | | | |
|---|---|---|---|---|
| 3,868,662 | * | 2/1975 | Russell Jr. | 73/862.471 |
| 4,068,223 | | 1/1978 | Steffen | 340/267 R |
| 4,138,898 | * | 2/1979 | Watts et al. | 73/772 |
| 4,546,346 | | 10/1985 | Wave et al. | 340/608 |
| 4,813,320 | * | 3/1989 | Malloy et al. | 83/61 |
| 5,063,729 | | 11/1991 | Fox et al. | 56/30 |
| 5,922,967 | * | 7/1999 | Motoyama | 73/794 |

* cited by examiner

*Primary Examiner*—Max Noori
(74) *Attorney, Agent, or Firm*—Fitch, Even, Tabin & Flannery

(57) ABSTRACT

A method of, and apparatus for, detecting level and blockages in an ore pass or other near-vertical shaft is described. The level and blockage detector includes a flexible metal strip in which a plurality of strain gages have been located, spaced apart from one another, preferably at known distances. A plurality of anchors secure the metal strip to the interior surface of the shaft such that the metal strip is displaced a fixed distance from the interior surface. The anchors are located intermediate the strain gages. When the ore pass fills up with bulk material, the bulk material causes the metal strip to deflect toward the interior surface of the shaft. This causes the resistance of the strain gage in the region of the deflection to change. To detect the location of the blockage, a microcontroller cycles through each strain gage, placing it as the fourth arm of a bridge circuit. When a change in the output voltage across the bridge circuit is detected, the location of the strain gage causing the change in output voltage is an indication of the presence of bulk material (ore). A series of LEDs, one for each strain gage, may be used to indicate which strain gage senses the presence of bulk material and which strain gage does not.

17 Claims, 6 Drawing Sheets

ORE PASS LEVEL AND BLOCKAGE LOCATOR DEVICE

BACKGROUND OF THE INVENTION

This invention relates to a method and apparatus for detecting fill level and blockages in ore passes and other vertical or near-vertical shafts.

Large commercial mining operations often involve mining several different ore bearing layers. The mined ore is delivered to trucks or the like in a main drive shaft located below the lowest ore bearing layer. Ore pass shafts are vertical or near-vertical shafts used to transport ore mined in the bearing layers down to the main drive shaft. The ore pass shafts can be from eight feet in diameter for cutout shafts and up to fifty feet in diameter for blasted out shafts. They run from fifty feet to two hundred feet in length, and in some occasion up to one thousand feet in length.

Ore passes, backfill raises, mine draw points, chutes and other near vertical raises frequently get blocked due to bridging material. Chutes and grain hoppers usually contain access panels for inspection of internal areas and are also relatively easily accessible outside. Ore passes are only accessible from the inside and present an extremely harsh environment. Because of this it is not easy to determine the location and source of the blockage.

Several methods exist for locating and detecting blockages in material handling systems. U.S. Pat. No. 5,063,729 to Fox et al. describes a cotton blockage detector for a harvester which uses an acoustic output directed toward the discharge door floor of the cotton picking unit. When the cotton picking unit is operating properly, the floor area is clear. When a blockage occurs, the area begins to fill with cotton and debris, causing a decrease in the monitored distance. U.S. Pat. No. 4,068,223 to R. Steffen describes a monitoring system for agricultural harvesting apparatus in which flow sensing means is mounted in a duct for the passage of the harvest. The apparatus senses changes in airflow, indicating when a blockage occurs. U.S. Pat. No. 4,546,346 to Wave et al. describes a sewer line backup detection, alarm and detention apparatus include a series of pneumatic switches coupled to a pressure sensitive diaphragms extending into the sewer at various locations. In the event of a sewer blockage, the blocked material exerts pressure on the diaphragm which closes the switch. None of these techniques is suitable for the rough environment of an ore pass.

Many bulk material level indicators are currently in use. The most common technologies involve the use of radio frequency (RF) and laser beams. A major disadvantage of these technologies is that they require an external mounting arrangement. Ore passes require an internal mounting arrangement since only the internal walls can be accessed.

Once a blockage is determined, the ore pass must be unblocked. Several techniques exist for unblocking ore passes and other near-vertical shafts: running water, boring and in extreme cases, explosives. While it is important for safety and productivity reasons to unblock the ore pass, it is also important to be able to locate the blockage areas quickly and efficiently. Knowledge of the extent and location of the blockage can also help determine the type and safest method for clearing it.

There is a need for an apparatus for detecting level and locating blockages in the rugged environment of an ore pass. There is a need for a low cost and easily installed level detector and blockage locator. There is a further need for a level detector and blockage locator which can withstand most non-explosive cleanout techniques. There is a need for a level detector and blockage locator which can be installed on the internal walls of an ore pass or other vertical rise.

SUMMARY OF THE INVENTION

To achieve the foregoing and other objects, a method of, and apparatus for, locating a blockage in an ore pass or other near-vertical shaft is described. The level and blockage detector includes a flexible metal strip in which a plurality of strain detectors or gages have been located, spaced apart from one another, preferably at known distances. A plurality of anchors secure the metal strip to the interior surface of the shaft such that the metal strip is displaced a fixed distance from the interior surface. The anchors are located intermediate to the strain detectors. The anchors prevent movement of the strip except between the anchors. Thus maximum deflection occurs at the center of the portion of the strip, at the location of the strain detector.

When the ore pass fills up with bulk material, the bulk material causes the metal strip to deflect toward the interior surface of the shaft. This causes the resistance of the strain detector in the region of the deflection to change.

To detect the location of the blockage or level of the bulk material, a microcontroller cycles through each strain gage, placing it as the fourth arm of a bridge circuit. When a change in the output voltage across the bridge circuit is detected, caused by a change in resistance of the strain detector, the location of the blockage can be determined. The level of tolerance of the location is somewhere in the range of the distance between the strain detectors. For example, referring to FIG. 1A, if a change in output voltage is detected at strain detector 1 and 2, but not at number 3 or 4, then the blockage is at or slightly below the location of strain detector 2.

Once the location of the blockage is determined, a display consisting of a series of light emitting diodes, (LED), one for each strain gage can be coupled to the bridge circuit. When a change in output voltage is detected across the bridge circuit, current is applied to the LED for that strain detector, causing it to light. Other means of displaying the location of the blockage or level may also be used. For example, CRT or LCD display may provide software driven data indicating the location of the blockage.

Preferably, the strain detectors and wiring are located on the inside surface of the metal strap or strip. This will prevent damage from the bulk material as it falls past the metal strap. Preferably, steel strapping may be used. Steel strapping of a thickness of at least about one eighth inch and width of about five inches provides sufficient rigidity and deformability to enable the strain detectors to be deflected during when material is present, but not during normal fall of the bulk material. The distance the metal strap is located from the interior surface of the shaft, as well as the dimensions of the metal strap, will vary depending on the type of bulk material. Occurrence of a blockage or a full ore pass should not, preferably, permanently deform the metal strap in the region of the blockage. However, if the strap is deformed permanently, the system can be recalibrated to zero out the deformation.

The system is comprised of relatively inexpensive components and can be easily installed in an ore pass. Run lengths of up to 200 feet of metal strap are possible without loss of signal strength. For longer shafts, multiple blockage locators can be installed.

DETAILED DESCRIPTION OF THE PREFERRED EMBODIMENTS

Figure 1:
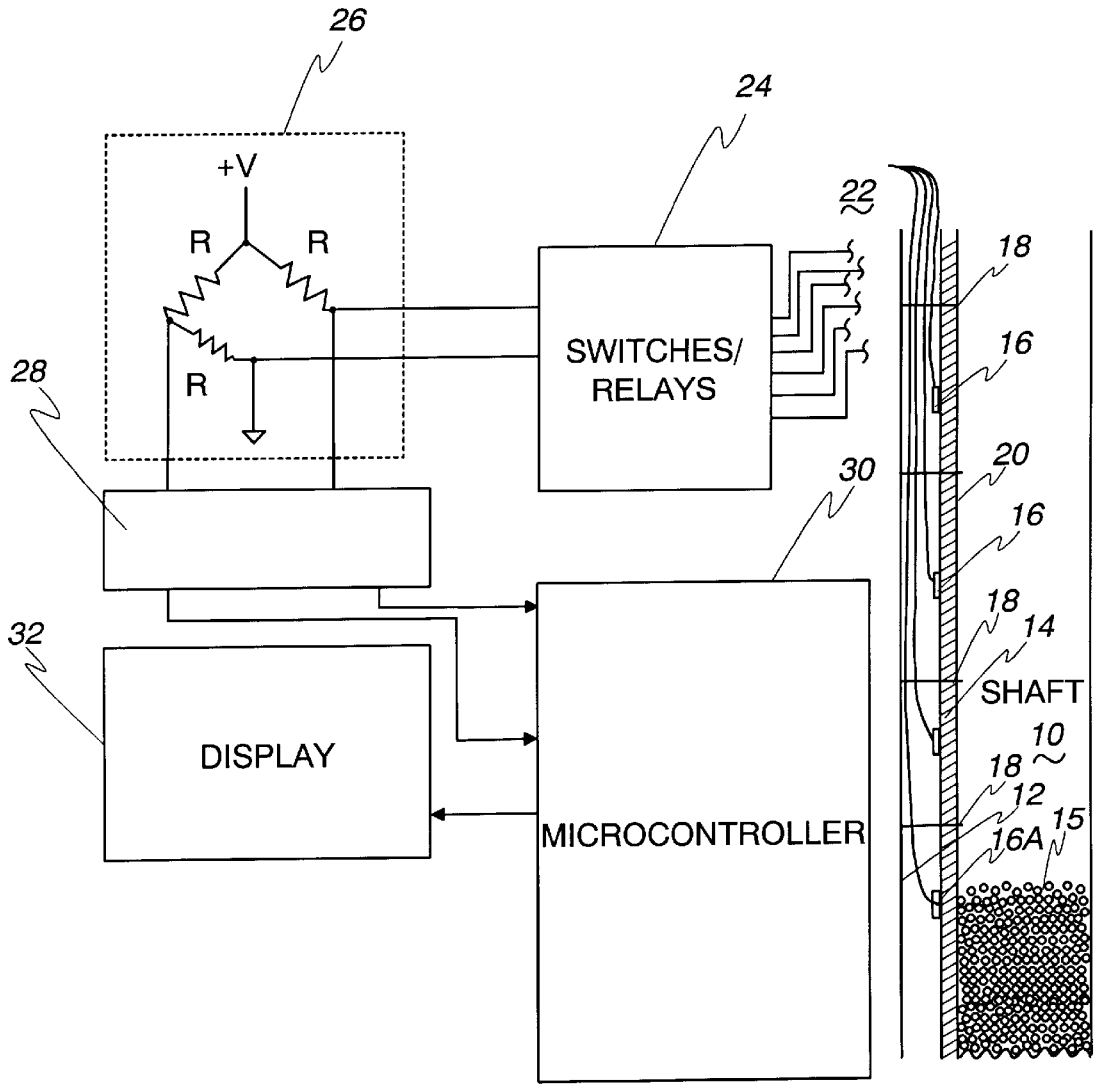
FIG. 1 is a schematic showing a system for level detection and blockage location according to the invention.
Figure 1A:
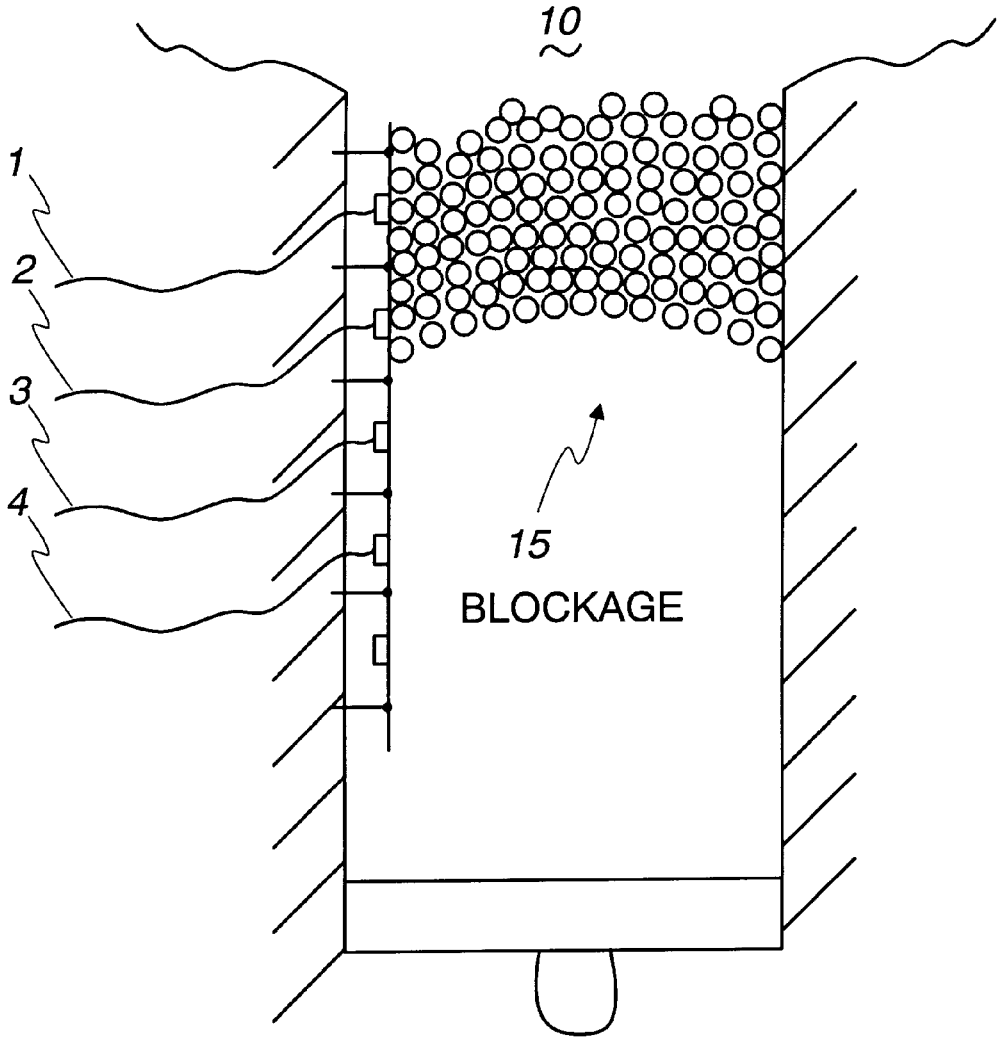
FIG. 1A is a cross-section of an ore pass showing a blockage relative to a group of strain detectors.

A system for detecting levels and locating blockages in an ore pass or other vertical or near-vertical shaft is shown schematically in FIG. 1. The system for detecting levels and locating blockages includes a strain detector 20 which is located within the interior of ore pass or shaft 10. Strain detector 20 comprises a flexible metal strap 14, which is secured to the interior surface 12 of shaft 10 using bolts with standoffs 18. Intermediate the bolts 18 are weldable strain gages 16 located on the interior surface of metal strap 14. Strain detector 20 provides multiple measurement points for the entire length of the shaft.

When bulk material 15 accumulates within shaft 10, it exerts pressure on strain gage 16A. A strain gage converts a small mechanical motion or deflection into an electrical signal by virtue of the fact that when the strain gage material (metal wire or foil or a semiconductor) is stretched in tension, its resistance is increased. The increase in resistance is a measure of the mechanical motion. Although, in this application, only the fact that tension is being applied by the bulk material is relevant, not the amount of force or deformation.

Preferably, strain gages 16 are weldable type bonded to stainless steel carriers and have integral three wire systems.

Microcontroller 30 causes switch assembly 24 to selectively connect each strain gage 16 into an arm of bridge circuit 26. Microcontroller 30 is preferably a Microchip Technology PIC. A microprocessor or other digital control device, such as an ASIC, gate array or programmable logic device may also be used. The output voltage of bridge circuit 26 is taken across signal conditioner 28. This output voltage is an analog signal which is converted by microcontroller 30 to a digital signal. As discussed above, the actual level of the signal across the strain gages is generally only important during calibration, since in this application, preferably only the fact of a pressure on the strain gage is used for location detection. Microcontroller 30 then outputs the information regarding which strain gage caused an output voltage above a threshold value (the threshold value determines whether or not bulk material is present at the location and causing pressure on the flexible metal strap and strain gage) to display 32. Display 32 may be of several forms. A simple, inexpensive output display is a series of LEDs, one for each strain gage. The strain gages may be laid out in an arrangement showing the location along the shaft, so that when the system tests for the presence of material, the appropriate LED will light up indicating graphically the location of the ore level or blockage.

Figure 2:
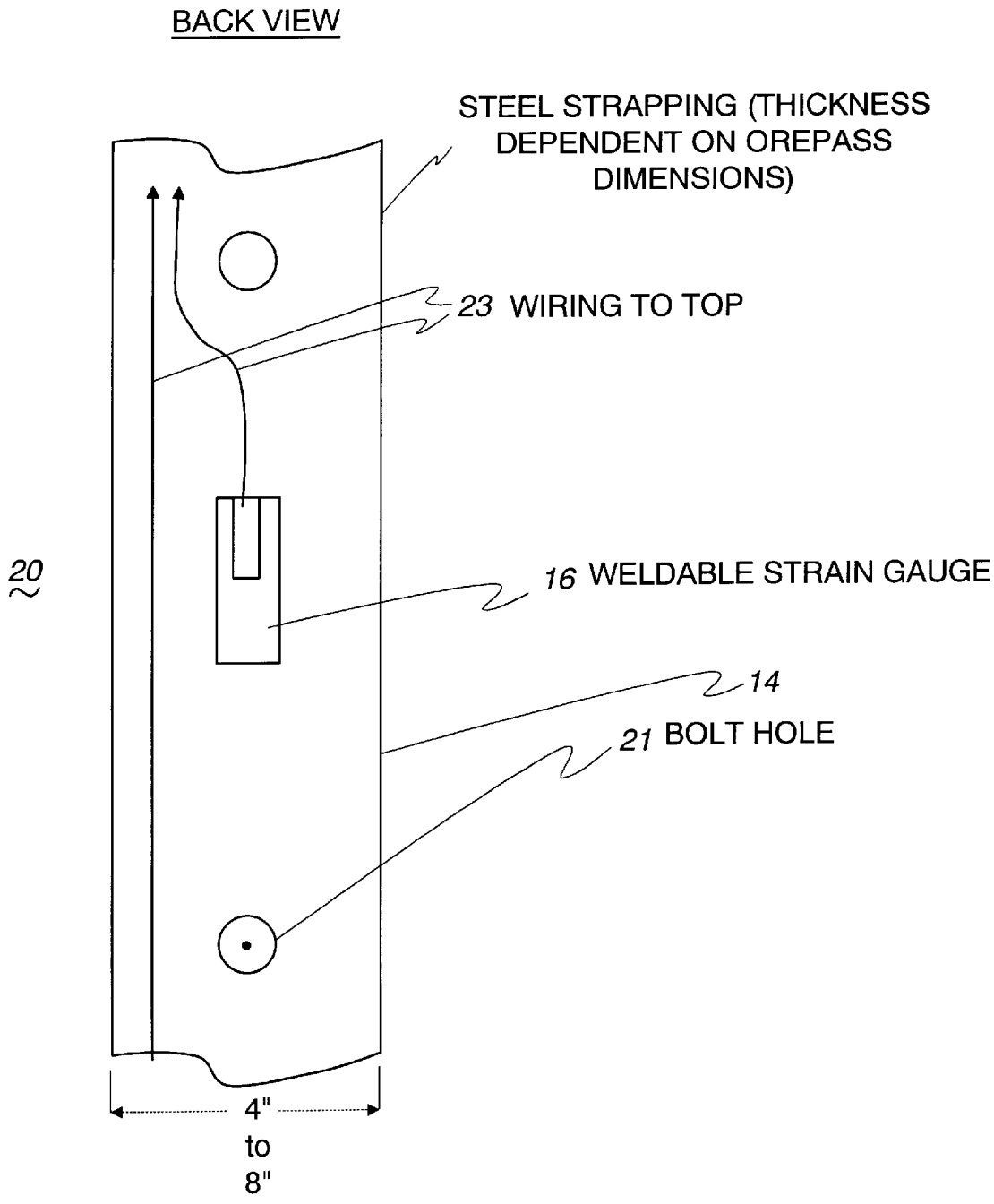
FIG. 2 is a back view of the level detection and blockage location device shown in FIG. 1.
Figure 3:
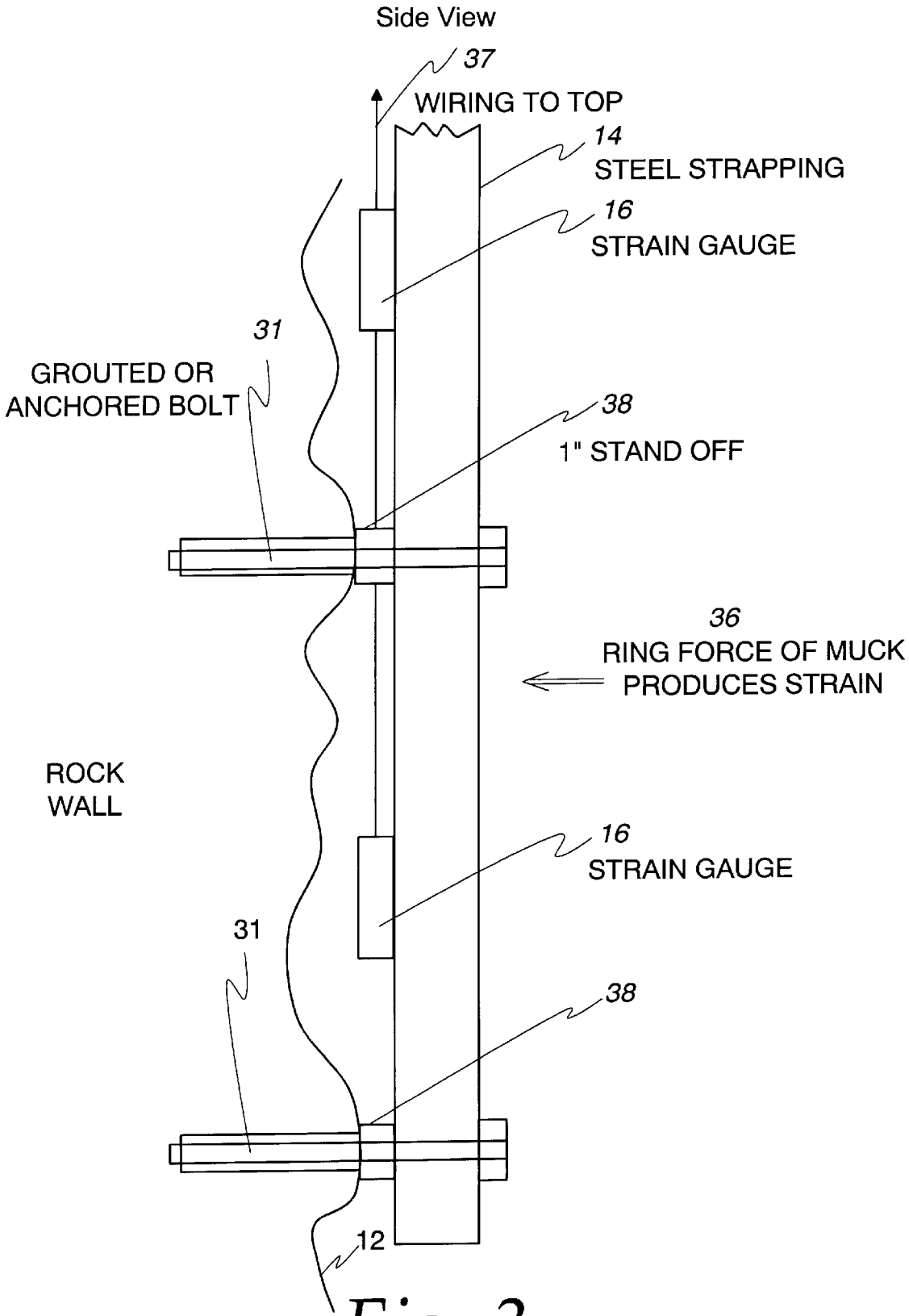
FIG. 3 is a side view of the level detection and blockage location device shown in FIG. 1.

Further details of strain detector 20 are shown in FIGS. 2 and 3. Referring to FIG. 2, a view of the back, i.e., the side which faces the interior surface 12 of shaft 10, is shown. Metal strap 14 is preferably a steel strapping. The thickness and dimensions depend on the size of the shaft. Width may vary from four inches to eight inches. Although other materials may be used, one eighth to one half inch thick steel strapping has the preferred amount of flexibility for this application. For example, for a bored out ore pass (one which has been carved out by a raise borer, and has a substantially circular cross section), a steel strap having a thickness of about three sixteenths inch and a width of about five inches is preferred. For longer and larger diameter ore passes, such as those which have been blasted out by explosives and have an irregular cross section, heavier steel may be required.

Holes 21 have been drilled to allow passage of the anchoring bolts. Weldable strain gage 16 has been welded to the surface and placed substantially mid way between each pair of bolts. Referring to FIG. 3, wiring 37 for each strain gage is also placed on the interior surface of metal strap 14 and exits the shaft at the top. Bolts 31 are grouted or otherwise anchored into drilled holes in shaft 10. Standoff 38 provides a setoff for metal strap 14 from interior surface 12. Preferably, the distance of the set off is about one inch for a anchor bolt to anchor bolt spacing of about twenty-four inches. Preferably, based on the strength and flexibility of the metal strap and the length of the ore pass, a placement of about twenty-four to forty-eight inches is preferred for the anchor bolts. By placing the strain gages 16 midway between pairs of anchor bolts, the distance between strain gages is also the same. Placing the strain gage midway between two anchor bolts enables the greatest deflection (and largest change in resistance) to occur at the location of the strain gage.

Figure 5:
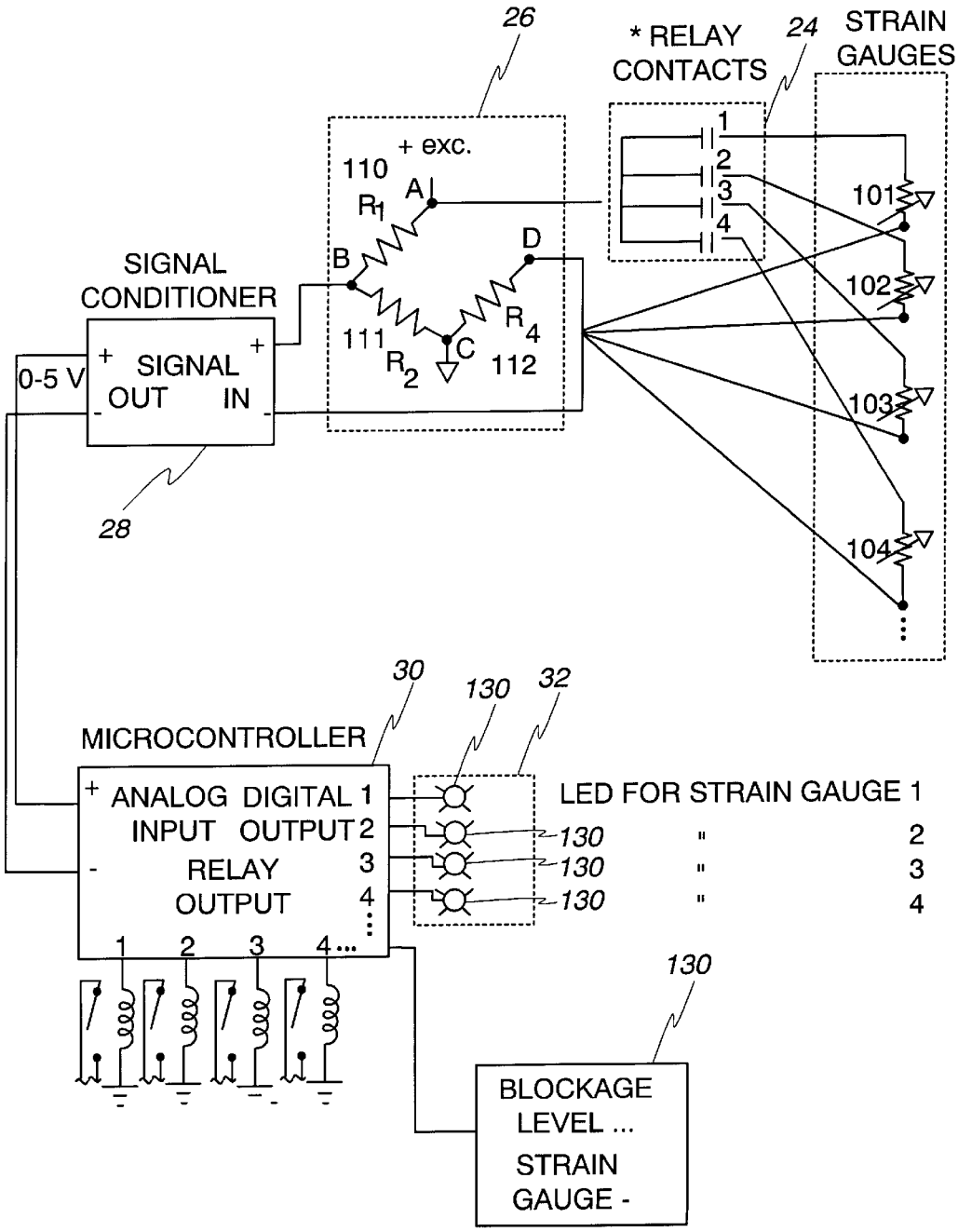
FIG. 5 is a schematic showing details of the electrical connections for the system shown in FIG. 1.

Strain gages 16 are shown as their electrical equivalent, variable resistors 101, 102, 103, 104 in FIG. 5. Strain gages 16 are placed as the fourth arm of a bridge circuit 26. Bridge circuit 26 includes three resistors 110, 111 and 112 in three arms. The value of resistors 110, 111 and 112 is determined by the at rest resistance of the strain gage 16. Output of the bridge circuit 26 is taken across terminals B and D. When the product of R1R4=R2R3 (with R3 the unstrained resistance of the strain gage), the voltage across terminals B and D is essentially zero. If the resistance of R3, the strain gage, changes due to pressure exerted by bulk material in the shaft from a blockage or level, a non-zero voltage will exist on terminals B and D.

The output voltage is taken across terminals B and D, which is also across signal conditioner 28. In its simplest form, signal conditioner 28 may be another amplifier. The output is then applied to the analog input of microcontroller 30, which determines the digital output and applies it to display 32. In FIG. 5, display 32 is shown as a series of LEDs 132, one corresponding to each strain gage. An alternative display is shown as CRT or LCD monitor 130. In this embodiment, microcontroller includes a software program which converts the raw location information based on detecting an output voltage from one or more strain gages, and converts it into data for a user to read.

For example, the display could show graphically a picture of the shaft with a representation of the blockage or level and numeric information about the depth and location.

Figure 4:
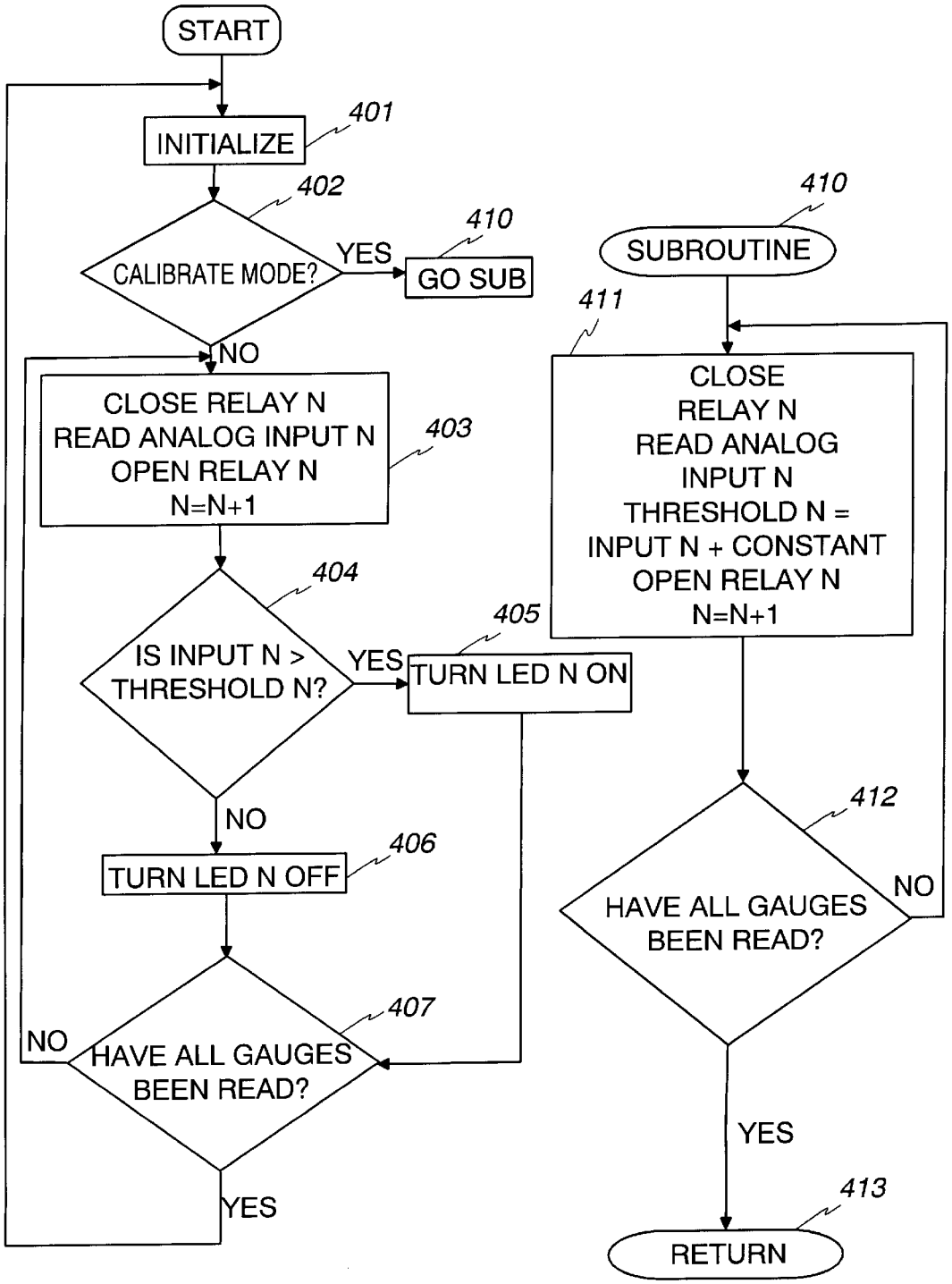
FIG. 4 is a flow chart showing the steps of a software routine for use in the microcontroller shown in FIG. 1.

Microcontroller 30 controls which strain gage is placed into the bridge circuit by enabling switch assembly 24, shown in FIG. 5 as a series of relay contacts. Operation of the level detector and blockage locator is described with reference to the flow chart in FIG. 4. The flow chart in FIG. 4 represents a software routine operated by microcontroller 30. After the system is started, the program goes through an initialization step 401 in which counters are set to zero. The program then checks if the user wants to calibrate the system at step 412. If the user selects calibration, the program calls the calibration subroutine.

Calibration is used to establish a threshold value for the strain gages. With use, the strain gages may be subject to some movement from the bulk material falling through the shaft. This will cause the base line resistance for some or all of the strain gages to change over time. Calibration is also performed after installation or replacement of the unit. As discussed above, a non-zero output across the bridge circuit for a particular strain gage is an indication of the presence of material near that strain gage. Calibration can also be adjusted to allow the user the set the sensitivity of the ore. Since all strain gages will not have the same resistance as the resistors in the other three arms, each strain gage must be measured under a no pressure situation to determine the minimum output voltage to be expected.

In step 411, the microcontroller cycles through each relay N, reading the output across the bridge circuit when each strain gage is connected. To establish a threshold for each strain gage, the microcontroller adds a constant number to the measured output voltage. The constant is adjustable but must be large enough to ensure detection of material. In step 412, the program checks for all gages being read, and recycles to step 411 until this is completed. In step 413, the subroutine returns to step 401.

Returning to step 402, if calibration is not needed, the routine branches to step 403. In step 403, the routine sequentially closes the relay or switch to each strain gage, placing it in the bridge circuit. After reading the output voltage, it closes the relay and opens the next relay and increments the counter to N+1. In step 404 it compares the measured output voltage with the threshold voltage for that strain gage. If the measured output voltage is greater than the threshold, the routine branches to step 405 and turns on the LED corresponding to the strain gage. If the output is less than the threshold value, the routine makes sure the LED for that strain gage is off. Note that in this routine, an LED display is assumed. The software would be different if some other display type were used. At step 407, the routine checks for all strain gages having been read. If not, it branches to step 403. Once all gages have been read, the routine ends by returning to step 401.

The invention has been described in terms of locating a blockage in an ore pass or underground shaft. The invention can also be used in hoppers or chutes. In the case of a hopper or chute or even a grain silo, it may be of interest to the user to be able to locate the depth of the bulk material or location of air pockets. Air pockets could be indicated by one or more unlit LEDs in a series of lighted LEDs.

While there has been illustrated and described a particular embodiment of the present invention, it will be appreciated that numerous changes and modifications will occur to those skilled in the art, and it is intended in the appended claims to cover all those changes and modifications which followed in the true spirit and scope of the present invention.

What is claimed is:

1. Apparatus for detecting the level of bulk particulate material in a shaft, the shaft having an interior surface, comprising:

a flexible metal strap having a first surface and a second surface;

a plurality of strain gages spaced apart from one another on the first surface of the metal strip, wherein deflection of the metal strip by bulk material in the region of a strain gage produces a change in resistance of the strain gage;

a plurality of anchors for anchoring the metal strap to the interior surface of the shaft such that the metal strap is displaced a predetermined distance from the interior surface of the shaft, wherein the anchors are located intermediate the strain gages;

a bridge circuit, having three fixed arms and a fourth arm, for detecting change in resistance of a strain gage;

a control circuit for selectively coupling the strain gages into the fourth arm of the bridge circuit; and a display for displaying the location of a strain gage having a change of resistance.

2. The apparatus of claim 1 wherein the strain gages are equally spaced from one another along the first surface.

3. The apparatus of claim 2 wherein the anchors are equally spaced apart from one another.

4. The apparatus of claim 2 wherein the control circuit comprises a microprocessor; a plurality of switches, one for each strain gage, responsive to a control signal from the microprocessor, for selectively connecting its respective strain gage into the fourth arm of the bridge circuit.

5. The apparatus of claim 1 wherein the display comprises a plurality of LEDs, one for each strain gage.

6. The apparatus of claim 4 wherein the display comprises a CRT monitor and wherein the control circuit further comprises a memory storing a routine for displaying data relating to the plurality of strain gages on the monitor.

7. The apparatus of claim 4 wherein the display comprises an LCD monitor and wherein the control circuit further comprises a memory storing a routine for displaying data relating to the plurality of strain gages on the monitor.

8. The apparatus of claim 2 wherein the control circuit comprises a microprocessor; a plurality of relays, one for each strain gage, responsive to a control signal from the microprocessor, for selectively connecting its respective strain gage into the fourth arm of the bridge circuit.

9. The apparatus of claim 1 wherein the first surface comprises the surface facing the interior surface of the shaft.

10. The apparatus of claim 1 wherein the metal strap comprises a steel ribbon.

11. The apparatus of claim 1 wherein the metal strap comprises a steel plate.

12. A method for detecting the level of bulk particulate material in a shaft, the shaft having an interior surface, comprising the steps of:

(a) providing a flexible metal strap having a first surface and a second surface, a plurality of strain gages spaced apart from one another on the first surface of the metal strap, wherein deflection of the metal strap by bulk material in the region of a strain gage produces a change in resistance of the strain gage, and a plurality of anchors for anchoring the metal strap to the interior surface of the shaft such that the metal strap is displaced a predetermined distance from the interior surface of the shaft, wherein the anchors are located intermediate the strain gages;

(b) providing a bridge circuit, having three fixed arms and a fourth arm, for detecting a change in resistance of a strain gage;

(c) selectively coupling a strain gage into the fourth arm of the bridge circuit;

(d) measuring the voltage across two adjacent arms of the bridge circuit;

(e) repeating steps (c) and (d) until all strain gages have been coupled into the bridge circuit; and (f) displaying the location of a strain gage having a change of resistance.

13. The method of claim 12 wherein step (f) comprises turning on an LED corresponding to a strain gage having a change in resistance.

14. The method of claim 12 wherein step (f) comprises displaying a message on a CRT monitor containing information regarding a strain gage having a change in resistance.

15. The method of claim 12 wherein step (f) comprises displaying a message on an LCD monitor containing information regarding a strain gage having a change in resistance.

16. The method of claim 12 further comprising the steps of:

(b1) establishing a threshold value of voltage for each strain gage; and (d1) calculating the difference between the measured voltage and the threshold value for the strain gage; and wherein step (f) comprises the step of, when the result of step (d1) is greater than zero, displaying the location of the strain gage.

17. The method of claim 12 further comprising the a calibration step, wherein the calibration step comprises the steps of:

(a1) selectively coupling a strain gage into the fourth arm of the bridge circuit;

(a2) measuring the voltage across two adjacent arms of the bridge circuit;

(a3) establishing a threshold value for the strain gage by adding a predetermined value to the measured voltage;

(a4) repeating steps (a1) through (a3) until all strain gages have been coupled into the bridge circuit.

* * * * *